United States Patent [19]

O'Sullivan

[11] Patent Number: 4,972,690

[45] Date of Patent: Nov. 27, 1990

[54] LOCKING CASSETTE CASE

[76] Inventor: Daniel J. O'Sullivan, 67 Bradford Ct., Aberdeen, N.J. 07747

[21] Appl. No.: 480,481

[22] Filed: Feb. 14, 1990

[51] Int. Cl.[5] ..... E05B 65/52

[52] U.S. Cl. ..... 70/63; 70/57; 70/288; 70/298; 70/315

[58] Field of Search ..... 70/63, 39, 57–58, 70/287–288, 297–298, 315–318

[56] References Cited

U.S. PATENT DOCUMENTS

| | | | |
|---|---|---|---|
| 435,915 | 9/1890 | Brooke | 70/298 |
| 937,286 | 10/1909 | Croswell | 70/298 |
| 2,512,020 | 6/1950 | MacMillan | 70/63 |
| 2,733,416 | 1/1956 | Evalt | 70/57 |
| 2,822,683 | 2/1958 | Kahn | 70/298 |
| 3,125,873 | 3/1964 | Robinson | 70/63 |
| 3,237,436 | 3/1966 | Williams | 70/63 |
| 3,590,614 | 7/1971 | Kunst | 70/63 |
| 3,837,692 | 9/1974 | Ayers | 70/63 |
| 4,499,745 | 2/1985 | Ricouard | 70/316 |
| 4,669,285 | 6/1987 | Kim | 70/316 |

FOREIGN PATENT DOCUMENTS

| | | | |
|---|---|---|---|
| 604569 | 6/1930 | Fed. Rep. of Germany | 70/298 |
| 2606774 | 1/1977 | Fed. Rep. of Germany | 70/298 |

*Primary Examiner*—Robert L. Wolfe

*Attorney, Agent, or Firm*—Schechter, Brucker & Pavane

[57] ABSTRACT

A locking video cassette case for a single video cassette includes a case defining a space to receive a video cassette, a lid hingedly secured to the case, a first locking member secured to a surface of the case, a second locking member secured to a surface of the lid, the first and second locking members incorporating means for locking the lid in a closed position, and means for manipulating the locking means for releasing the lid from the closed position.

3 Claims, 5 Drawing Sheets

LOCKING CASSETTE CASE

BACKGROUND OF THE INVENTION

1. Field of the Invention

This invention relates generally to cassette cases, and in particular to such cassette cases as are used for the storage of video cassettes.

2. Background Art

Existing cassette cases merely protect the cassette from dust, dirt and abuse. Typically, they do not lock, though some cassette cases do exist which will lock a plurality of cassettes in a single holder. Such holders tend to be expensive and bulky, and not practical for locking single cassettes.

With the proliferation of home video cassettes, and particularly those containing adult material, it is desirable to provide means for rendering such cassettes inaccessible to younger viewers. There has also been a proliferation of video rental outlets, and many of these also rent cassettes containing adult material. Here too there is a need for means for rendering a single cassette inaccessible to younger viewers when the rental cassette is brought home. However, it is important that such means not be so bulky as to render the cassette cumbersome to transport. Also, it is important that any such device not be so expensive that it becomes impractical to implement on a large scale basis.

SUMMARY OF THE INVENTION

It is therefore a principal object of this invention to provide a means for economically and effectively restricting access to a video cassette on an individual cassette basis. A further object is for such means to additionally protect the cassette from dust, dirt and abuse.

This and other objects are achieved by the present invention which is for storing and locking a single video cassette. The invention will be more fully apparent from the following detailed description and annexed drawings of the presently preferred embodiments thereof. It will be seen from the presently preferred embodiments that the locking cassette of the present invention is substantially the same size and shape as the non-locking holders currently employed for storing a single cassette.

DETAILED DESCRIPTION OF THE DRAWINGS

Figure 1:
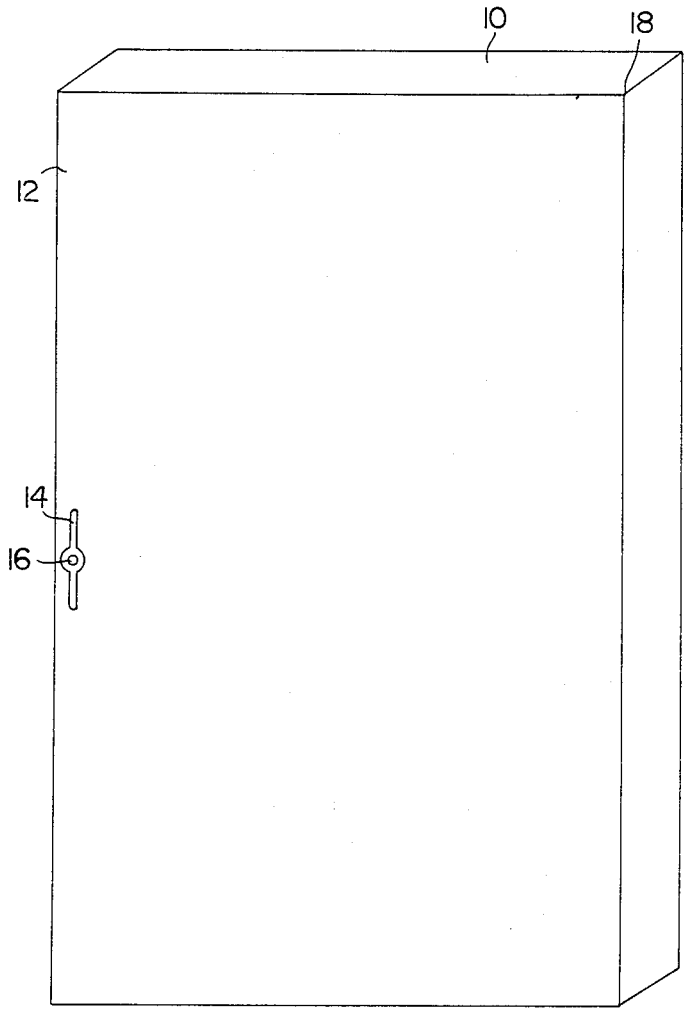
FIG. 1 is a perspective view of one form of the invention in the locked position.
Figure 2:
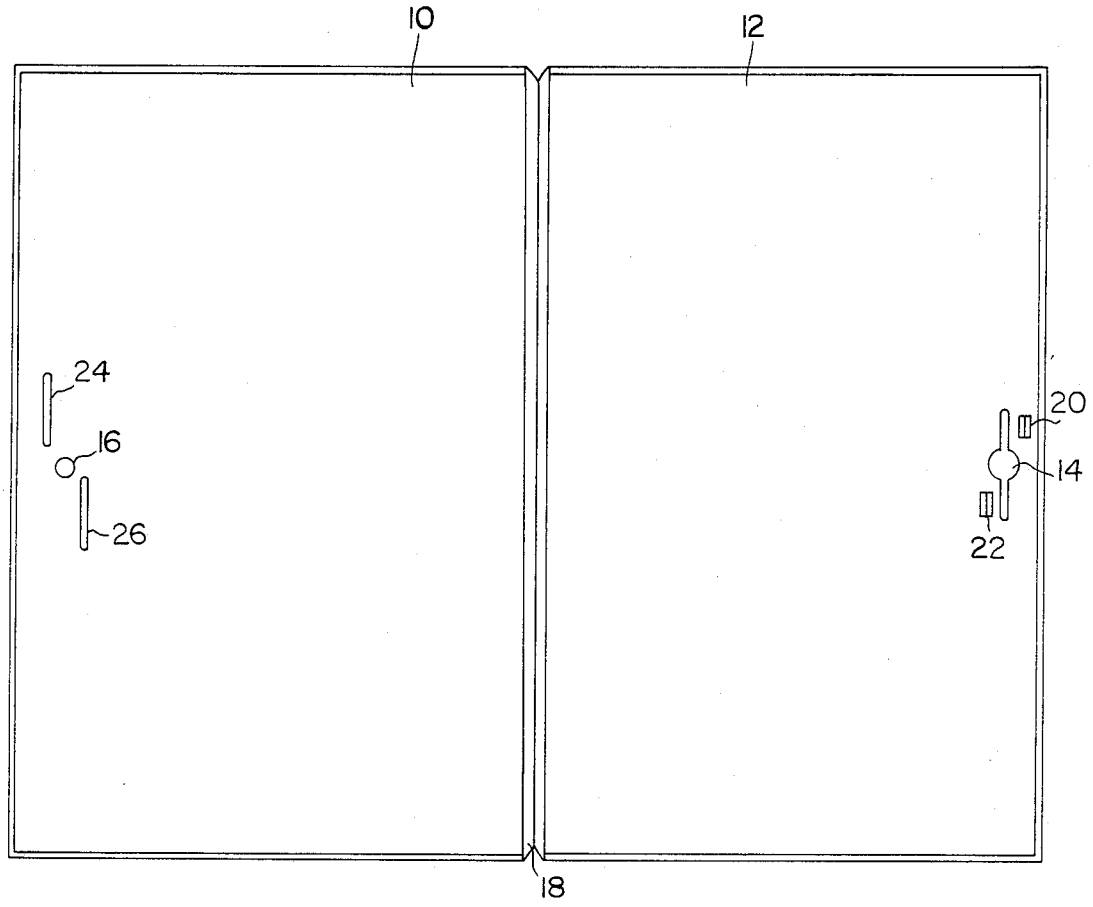
FIG. 2 is a front view of the embodiment of FIG. 1 shown in the open position.

Referring initially to FIGS. 1 and 2, a preferred locking video cassette case in accordance with the invention comprises the usual case 10 having a lid 12 secured thereto by a hinge 18. In accordance with the invention, a keyhole 14 is cut in the lid 12 and a key guide 16 is secured to the inside face of the case 10, the guide 16 aligning with the keyhole 14 when the lid 12 is closed (see FIG. 1).

FIG. 2 shows the key guide 16 as well as an upper grip member 24 and a lower grip member 26, both of which are also secured to and preferably integral with the inside face of the case 10 on either side of key guide 16. FIG. 2 also shows an upper grip arm 20 and a lower grip arm 22 secured to the inside face of the lid 12.

Figure 3:
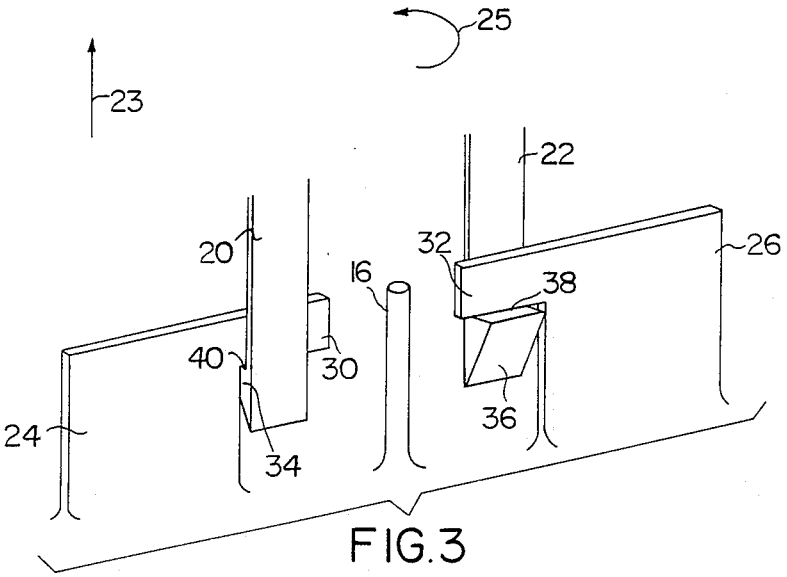
FIG. 3 is a fragmentary perspective view of the locking mechanism employed in the embodiment of FIG. 1.

FIG. 3 shows in detail the locking mechanism of FIGS. 1 and 2 in the locked position. As illustrated, the upper grip member 24 has a locking arm 30 which engages with a shoulder 40 defined by a wedge-shaped member 34 at the free end of the upper grip arm 20. The lower grip member 26 likewise has a locking arm 32 which engages a shoulder 38 defined by a wedge-shaped member 36 at the end of the lower grip arm 22. Thus, in the locked position of FIG. 3, the lid 12 is prevented from opening (direction of opening indicated by arrow 23) by means of the grip members 24, 26 engaging the shoulders 38, 40 of the upper and lower grip arms, 20 and 22, respectively. Thus, in the locking position the case 10 and lid 12 ar effectively locked closed.

Figure 4:
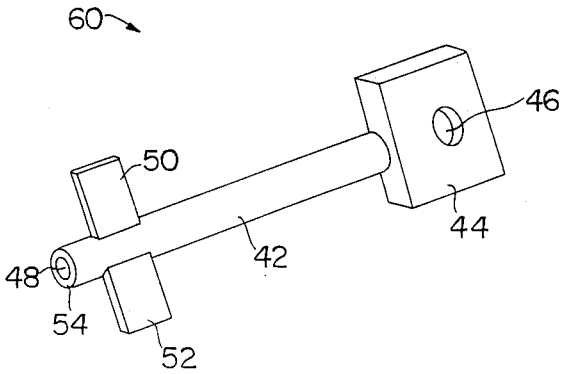
FIG. 4 is a perspective view of the key required to open the locking mechanism of FIG. 3.

FIG. 4 shows a key 60 for unlocking the lid 12 from case 10. The key 60 comprises a shaft 42, an attached handle 44 having a keyring hole 46, and key blades 50 and 52 extending in opposite directions from one end of the shaft 42. As shown at 48, the shaft 42 is hollow.

To unlock the locking mechanism of FIG. 3, the free end 54 of the key 60 is inserted into the keyhole 14 (FIG. 1) with the key guide 16 being received in the hollow 48 for guiding the key into the keyhole. The key is pushed into the keyhole until the free end 54 of the shaft 42 meets the back wall of the case 10. When the key 60 is then turned in the direction indicated by arrow 25 in FIG. 3, the key blades 50 and 52 push against the wedge-shaped members 34 and 36. When a sufficient turning force is applied, the shoulder 40 of the upper grip arm 20 disengages from the upper locking arm 30 and the shoulder 38 of the lower grip arm 22 disengages from the lower locking arm 32. This allows the lid 12 and attached upper and lower grip arms 20, 22 to be opened away from case 10 in the direction of arrow 23. The key 60 may then be removed from the keyhole 14 for safekeeping.

The cassette case may be closed by simply squeezing the case 10 and lid 12 together near the keyhole 14. When this is done, the wedge-shaped member 34 slides over the locking arm 30. Due to its wedge-shape, as the member 34 slides over the locking arm 30, the grip arm 20 is urged away from the grip member 24 until the shoulder 40 slides past the locking arm 30. At that point, the resilience of the grip member 24 snaps the grip member 24 back against the locking arm 30 with the shoulder 40 engaging the underside of the locking arm. It will be apparent that as this occurs, the lower wedge-shaped member 36 is simultaneously sliding over the lower locking arm 32 until its shoulder 38 slides past the locking arm 32 and engages the underside thereof. Once the shoulders 38, 40 engage the locking arms 32, 30, respectively, the case 10 and lid 12 are again in the locked position illustrated in FIG. 3. The upper and lower grip arms 20, 22 are preferably comprised of plastic, the selection of the suitable plastic having the necessary resiliency being well within the capabilities of one of ordinary skill in the art. Preferably, the entire cassette case is comprised of the same plastic.

Figure 5:
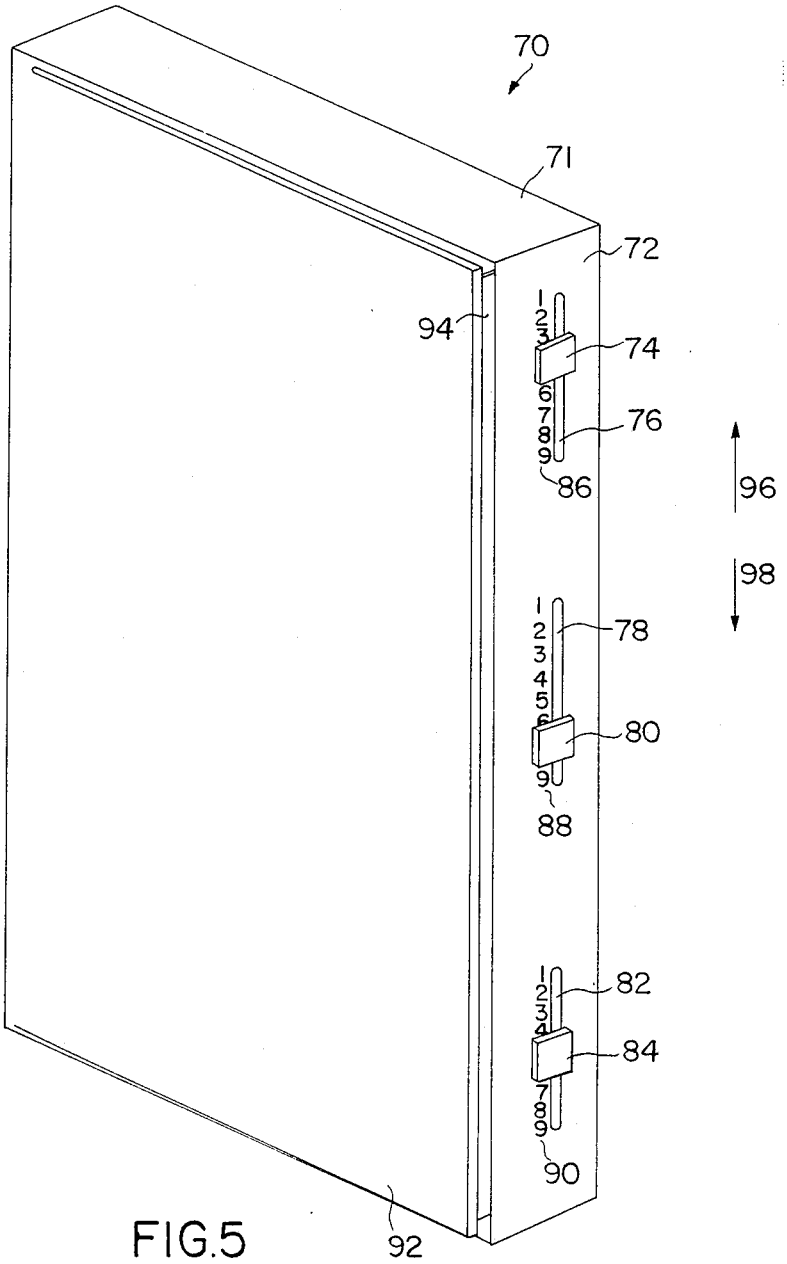
FIG. 5 is a perspective view of another form of the invention.

In FIG. 5 another form of a locking cassette case in accordance with the invention is generally designated at 70. As shown, it consists of base 71 having an outer locking face 72, and a hinged door or lid 92 having an inner locking face 94.

Figure 6:
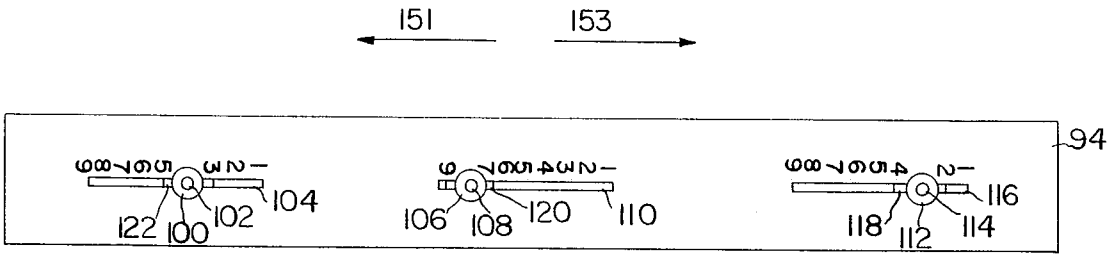
FIG. 6 is a front plan view of the inner locking face in the form of the invention shown in FIG. 5.
Figure 7:
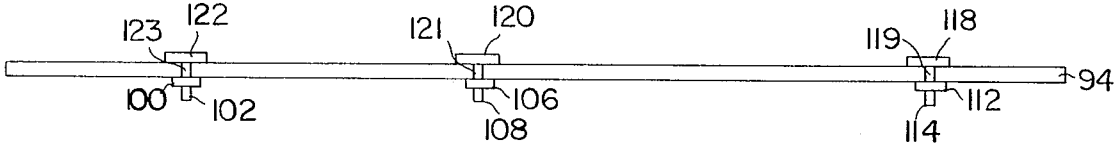
FIG. 7 is a side view of the inner locking face in the form of the invention shown in FIG. 5.

The outer locking face 72 has lock slides 74, 80 and 84 secured for a friction slide within the lock grooves 76, 78 and 82, respectively, such that the slides are capable of sliding movement in the directions indicated by arrows 96 and 98. Lock numbers 86, 88 and 90 are printed adjacent the lock grooves 76, 78 and 82, respectively, on the outer locking face 72. The manner of securing lock slides 74, 80, 84 in grooves 76, 78, 82 is more fully explained below. As shown in FIGS. 6 and 7, the inner locking face 94 has inner lock grooves 104, 110 and 116. Inner lock slides 122, 120 and 118 are disposed, respectively, in lock grooVes 104, 110 and 116 for a friction slide in the directions indicated by arrows 151 and 153. Each lock slide 122, 120, 118 has, respectively, an inner friction grip 100, 106, 112 each of which, in turn, has a protrusion 102, 108 and 114, respectively. The inner lock slides 122, 120, 118 are connected to the friction grips 100, 106, 112 by posts 123, 121, 119, respectively, the length of the posts being selected to achieve a friction slide of slides 122, 120, 118 in grooves 104, 110, 116. Consequently, the inner lock slides 122, 120 and 118 may be selectively slid in their respective inner lock grooves 104, 110 and 116 in the directions indicated by arrows 151 and 153 by applying enough thumb pressure to overcome the friction between the inner lock slides 122, 120, and 118 and the face 94.

Figure 8:
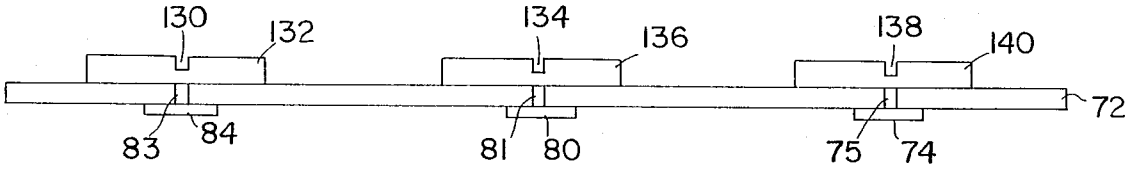
FIG. 8 is a side view of the outer locking face in the form of the invention shown in FIG. 5.
Figure 9:
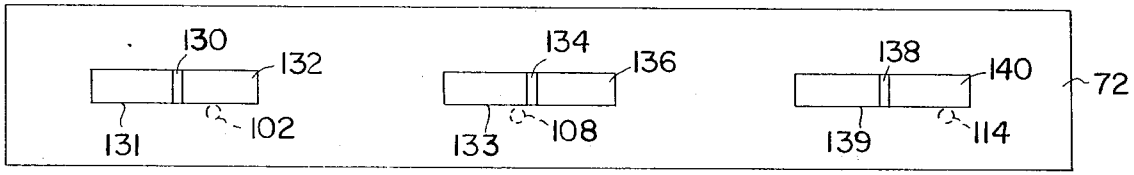
FIG. 9 is a front plan view of the outer locking face in the form of the invention shown in FIG. 5.

FIGS. 8 and 9 show the outer locking face 72 with lock slides 84, 80 and 74 connected, respectively, to the lock bars 132, 136 and 140 by posts 83, 81, 75. Here too the posts 83, 81, 75 are dimensioned to establish a friction slide of slides 84, 80, 74 in grooves 82, 78 and 76, respectively. As shown, each lock bar 132, 136, 140 has a gate or opening 130, 134, 138, respectively. When the base 71 and lid 92 are in their locked positions, the grooves 104, 110, 116 in the lid face 94 are offset from the grooves 76, 78, 82 in the face 72 of the base 71 whereby the protrusions 102, 108, 114 are disposed adjacent the inner sides 131, 133, 139 of the lock bars 132, 136, 140, respectively. This is best illustrated in FIG. 9, wherein the protrusions 102, 108 and 114 are illustrated in phantom. Only when the protrusions 102, 108 and 114 are aligned with the lock gates 130, 134, 138, respectively, will the protrusions be able to slip past the lock bars 132, 136, 140 thereby allowing the lid 92 to be opened. If even one of the protrusions 102, 108, 114 is not properly aligned with its respective lock gate, the lid will not open.

As shown, the lid face 94 has numeric indicators imprinted thereon adjacent the grooves 104, 110, 116 which correspond to the numeric indicators adjacent the grooves 76, 78 and 82 on the case face 72. A particular combination for opening the cassette case is selected by presetting the positions of the inner lock slides 118, 120 and 122 to numeric positions corresponding to the desired three digits combination. Then, cassette case 70 can only be opened by moving the outer lock slides 74, 80, 84 to the correct combination. Accordingly, the user is provided with a unique, presettable and resettable combination of digits for unlocking the cassette case 70.

While I have herein described certain preferred embodiments of the present invention, it will be apparent from this description that various changes, modifications, omissions and substitutions may be made therein without departing from the spirit and scope of this invention. For example, to prevent the video cassette from striking the locking mechanism, a partition may be molded into the interior of the case thereby providing separate compartments for the video cassette and for the locking mechanism. Accordingly, the above description should be construed as illustrative, and not in a limiting sense, the scope of the invention being defined by the following claims.

I claim:

1. In a cassette case for a single video cassette of the type including a case defining an interior space dimensioned to snugly receive a video cassette, and a lid hingedly secured to the case for movement between an open position wherein the lid exposes the interior space of the case to accommodate insertion and removal of a video cassette, and a closed position wherein the lid overlies the case for enclosing the interior space, the improvement comprising:

a plurality of first locking members secured to a surface of said case;

a corresponding plurality of second locking members secured to a surface of said lid in confronting relation with said surface of said case when said lid is closed, said first and second locking members incorporating means for locking said lid in said closed position, one of said lid surface and said case surface being outside the other when said cassette case is closed;

each of said first locking members comprising a first groove in said case surface and a first slide member secured for a friction slide in said first groove, each of said first slide members including a locking bar extending through said first groove towards said lid surface, each of said locking bars having an opening therethrough;

each of said second locking members comprising a second groove in said lid surface and a second slide member secured for a friction slide in said second groove, each of said second slide members including a protrusion extending through said second groove toward said case surface, each of said protrusions being dimensioned for passage through the corresponding opening in the corresponding locking bar; and the outside one of said lid and case surfaces having a plurality of actuating members associated therewith, each of said actuating members being disposed in the outermost surface of said outside surface and being secured to the corresponding slide member through the corresponding groove whereby manipulation of each of said actuating members along said corresponding grooves moves said last-mentioned slide members therewith;

each of said protrusions abutting said locking bars when said cassette case is closed, said cassette case being locked when one of said protrusions is out of alignment with the corresponding opening in the corresponding locking bar, and said lid being movable to said open position by moving said actuating members to positions wherein said protrusions and said openings are aligned, whereupon said protrusions are movable through said openings as said lid is opened, movement of each of the slide members associated with the innermost of said lid and case surfaces when said lid is closed varying the position of alignment between the corresponding protrusion and the corresponding opening.

2. The locking cassette case according to claim 11, wherein all of said first grooves have a plurality of indicia adjacent thereto and wherein all of said second grooves have a plurality of corresponding indicia adjacent thereto.

3. The locking cassette case according to claim 1, wherein said surface of said case comprises a side surface thereof; wherein said surface of said lid comprises a side surface thereof; and wherein said outermost surface is said side surface of said case.

* * * * *

UNITED STATES PATENT AND TRADEMARK OFFICE

CERTIFICATE OF CORRECTION

PATENT NO. : 4,972,690

DATED : November 27, 1990

INVENTOR(S) : O'Sullivan

It is certified that error appears in the above-identified patent and that said Letters Patent is hereby corrected as shown below:

Column 2, line 31, change "ar" to -- are --.

Column 3, line 24, change "grooVes" to -- grooves --.

Signed and Sealed this

Twenty-seventh Day of April, 1993

*Attest:*

MICHAEL K. KIRK

*Attesting Officer*

*Acting Commissioner of Patents and Trademarks*